United States Patent [19]

Gehring

[11] Patent Number: 4,702,284

[45] Date of Patent: Oct. 27, 1987

[54] METHOD AND APPARATUS FOR INSERTING WEFT THREADS INTO THE LOOM SHED OF SHUTTLELESS LOOMS

[75] Inventor: Fritz Gehring, Lindau-Bodolz, Fed. Rep. of Germany

[73] Assignee: Lindauer Dornier Gesellschaft mbH, Lindau, Fed. Rep. of Germany

[21] Appl. No.: 879,991

[22] Filed: Jun. 30, 1986

[30] Foreign Application Priority Data

Jul. 11, 1985 [DE] Fed. Rep. of Germany ..... 3524727

[51] Int. Cl.[4] ..... D03D 47/34

[52] U.S. Cl. ..... 139/446; 139/450

[58] Field of Search ..... 139/450, 453, 444, 445, 139/446, 448

[56] References Cited

U.S. PATENT DOCUMENTS

| | | | |
|---|---|---|---|
| 3,519,028 | 2/1970 | Golobart | 139/448 |
| 4,143,684 | 3/1979 | Lindenmueller et al. . | |
| 4,540,028 | 9/1985 | Gehring et al. | 139/450 |

FOREIGN PATENT DOCUMENTS

| | | | |
|---|---|---|---|
| 3042053 | 11/1982 | Fed. Rep. of Germany | 139/453 |
| 3243628 | 1/1985 | Fed. Rep. of Germany . | |
| 1392329 | 4/1975 | United Kingdom . | |

*Primary Examiner*—Henry S. Jaudon

*Attorney, Agent, or Firm*—W. G. Fasse; D. H. Kane, Jr.

[57] ABSTRACT

The weft thread is inserted into a loom shed by a gripper seizing the thread end with clamping jaws. The thread end is presented to the jaws by a suction effect when the jaws are at a standstill or just starting to move toward the loom shed. The suction effect cooperates with a thread pull-back member and, if desired, with an auxiliary thread clamp for shortening the length of thread protruding from the jaws to reduce waste. The suction effect is applied by a suction pipe having a suction slot extending across the suction pipe in the direction of the weft thread between a cut-off point and a thread presenting eyelet. The suction slot merges into a suction channel leading the free thread end into the clamping jaws and for continuously holding the thread end between cut-off and renewed seizing of the thread end by the gripper clamping jaws for a gentle handling of the weft thread.

13 Claims, 6 Drawing Figures

METHOD AND APPARATUS FOR INSERTING WEFT THREADS INTO THE LOOM SHED OF SHUTTLELESS LOOMS

FIELD OF THE INVENTION

The invention relates to a method and apparatus for inserting weft threads into the loom shed of shuttleless looms. The insertion is accomplished by thread clamping grippers carried by gripper rods travelling back and forth into the loom shed.

DESCRIPTION OF THE PRIOR ART

In looms of this type the gripper rods with their clamping grippers for seizing and inserting the weft thread are operatively mounted outside of the loom shed. The clamping grippers are constructed for holding and transferring the weft thread. For this purpose the clamping grippers are operated by externally arranged control levers or control rails. A thread presenting device selects the weft thread next to be inserted from a plurality of threads coming from supply rollers and presents the selected thread to the clamping gripper. The thread presenting device comprises a plurality of thread presenting needles equipped with eyelets through which the respective weft thread is guided. The thread presenting needles bring the thread from a rest position into such a position that the presented thread may be seized by the forwardly moving clamping gripper. The inserted weft thread is then beat-up and severed by scissors or similar severing device located close to the fabric edge or selvage. After severing, the free end of the weft thread still passing through the eyelet of the presenting needle to the supply roller is available for a new weft thread insertion. The just described loom is, for example, disclosed in U.S. Pat. No. 4,143,684.

German Patent (DE-PS) No. 3,243,628 discloses a shuttleless loom in which the grippers are also equipped with clamping devices and wherein a thread presenting mechanism is equipped with movable thread guides for presenting the respective, selected weft thread in a defined position for the seizing by the clamping mechanism of the grippers. A severing mechanism is arranged for severing an inserted weft thread from the respective supply reel or spool. A thread end holder is located between the severing mechanism and the path of the gripper for holding the free end of the presented and cut weft thread. The movable thread guides are arranged in such a manner that their thread guide portions, that is the guide eyelets, are located at the same point when any one of these thread guides are moved into the working position. This known loom acccording to German Patent No. 3,243,628 also includes a device for pulling the free end of the selected weft thread to a certain extent out of the thread holder.

In both of the prior art looms described above the weft thread presented by the thread presenting device is seized or taken over by the insertion gripper during the first phase of the insertion gripper movement. This entails that the presented thread is seized by the clamping mechanism as the gripper is moving forwardly. Seizing the weft thread while the gripper is moving has a number of disadvantages. For example, at the time of thread transfer the thread is subject to a jerky acceleration and thus to a substantial stress. Such stress becomes the larger the later the thread is taken over. More specifically, the stress is the higher, the larger the speed of the forwardly moving gripper is. Another disadvantage is seen in that the clamping mechanism of the grippers requires a rather high clamping force to make sure that the weft thread can be securely seized by the forwardly moving gripper. Such a high clamping force applies a strong pinching stress to the thread by the clamping jaws. As a result, there is the danger that the portion of the weft thread subject to the pinching stress can be severed altogether or at least damaged to such an extent that the weft thread has a tendency to rip during the further weft thread insertion.

As the operational speed of the loom increases the insertion speed of the weft thread also increases so that the spring forces needed for closing the gripper clamping device also become larger and larger. At higher speed the mass inertia moment of the clamping lever must also be reduced in order to enable the clamping lever to properly follow or respond to the high speed of the respective control cam of a control rail. These features are necessary to enable the clamping lever to properly seize the weft thread in what little short time is available for that purpose. Another disadvantage is seen in that the clamping device must be operated during the movement of the gripper rod, whereby it is necessary that the clamping lever must slide along below the mentioned control cam or control rail. As a result, the wear and tear is substantial and increases especially with increasing operational speeds. This wear is especially effective on the clamping lever and the control rail and even the gripper head itself is subject to substantial wear and tear because the sliding shoe of the gripper head is exposed to relative high frictional forces along the guide rail due to the contact pressure between the sliding shoe and the control rail while the control rail is moving.

It is necessary that the clamping device prior to the entry of the gripper into the loom shed is either completely closed or it is respectively covered in order to prevent that any warp threads that might get into the way of the moving gripper are torn or "shot down" by the not completely closed gripper clamping device. If the complete closing of the gripper takes place just prior to the entry of the gripper into the loom shed, the smaller will be the time available for the weft thread cutter for severing the weft thread to be inserted into the loom shed from the selvage at the entrance into the loom shed.

The length of the weft thread ends resulting from the cutting and extending between the gripper clamping device and the cutting location differ, depending on the thickness of the weft threads. This is so because during the closing phase of the gripper clamping device, the clamping action becomes effective sooner for thicker weft threads and later for thinner weft threads sliding through the clamping jaws of the gripper clamping device. However, it is desirable to have the same length for all cut-off weft thread ends.

OBJECTS OF THE INVENTION

In view of the foregoing it is the aim of the invention to achieve the following objects singly or in combination:

to avoid the above problems and disadvantages encountered by the prior art when seizing and clamping the weft thread by the gripper travelling forwardly into the loom shed;

to assure a safe, yet gentle thread seizing by the clamping device of the gripper head; and to make sure that the cut-off ends of the weft thread extending from the selvage always have the same length independently of the thickness of the weft threads.

SUMMARY OF THE INVENTION

The present method of inserting weft threads into a loom shed is performed in a shuttleless loom by gripper clamping devices carried by gripper rods moving into and out of the loom shed. The loom further has movable thread guides for presenting a selected weft thread to the gripper clamping device in a defined position. A thread severing device cuts an inserted weft thread from its supply spool at a point between the binding location at the fabric edge or selvage and the gripper rod path. A thread end holder is located between the severing device and the gripper rod path for temporarily holding the end of the thread cut by the severing device and for guiding the thread end into the gripper clamping device. A pull-back member pulls a length of cut thread out of the thread end holder. The present method comprises the steps of seizing the selected, cut thread by the thread end holder, guiding and inserting the held or seized thread into the gripper clamping device which is either at a standstill or substantially at a standstill at this time, continuing to hold the cut thread end in a yielding manner, maintaining the yielding effect of the thread end holder while pulling back a portion of the free weft thread end out of the thread end holder to shorten the free weft thread end, and closing the gripper clamping device, at the latest, when said gripper rod starts moving, for seizing the shortened weft thread end and for pulling the weft thread end out of the thread end holder when the gripper moves forward toward the loom shed. According to the invention the thread clamping takes place while the gripper is at a standstill or substantially at a standstill. Hence, it is possible to apply minimal clamping forces, whereby a substantially more gentle clamping of the thread is accomplished than is possible in the prior art. These advantages of the invention are achieved even if, due to a small time overlap in the sequence of the thread seizing or transfer, the clamping takes place while the gripper clamping device is not completely at a standstill. Thus, these advantages are achieve at least partially when the gripper motion is at minimal speed just after its return phase. The invention makes possible a gentle acceleration of the thread in accordance with the gripper rod movement function, thereby avoiding a jerky stress on the thread. Further, the clamping device itself and the components needed for controlling and operating the clamping device, can now have a lighter construction because the long control rail having a control cam with which the clamping levers used to be in sliding contact, can now be replaced by a narrower and lighter control finger or control lever which is able to operate the clamping device while it is at a standstill or while it is moving very slowly.

The advantage of the weft thread pull-back member is seen in that it provides optimally short weft thread ends, all of which always have the same length at the gripper and this advantage is achieved independently of the thickness of the weft thread, thus reducing waste.

According to the invention the holding device for the free weft thread end is constructed as a suction pipe having a suction opening located near the thread cutting location and a suction thread guide channel merging into the suction opening. The suction channel extends into the range of the gripper clamping device when the gripper is in its pulled back position. The suction opening of the suction pipe is advantageously constructed as a cut-in slot extending in the direction of the stretched-out weft thread and thus in the direction of a line connecting the respective thread presenting eyelet with the binding point at the fabric edge, in order to properly seize the cut weft thread end by the suction opening of the thread end holder.

The thread pull-back member may be constructed as is shown in the above mentioned German Patent (DE-PS) No. 3,243,628 and is arranged between the thread presenting device and the path of the gripper.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
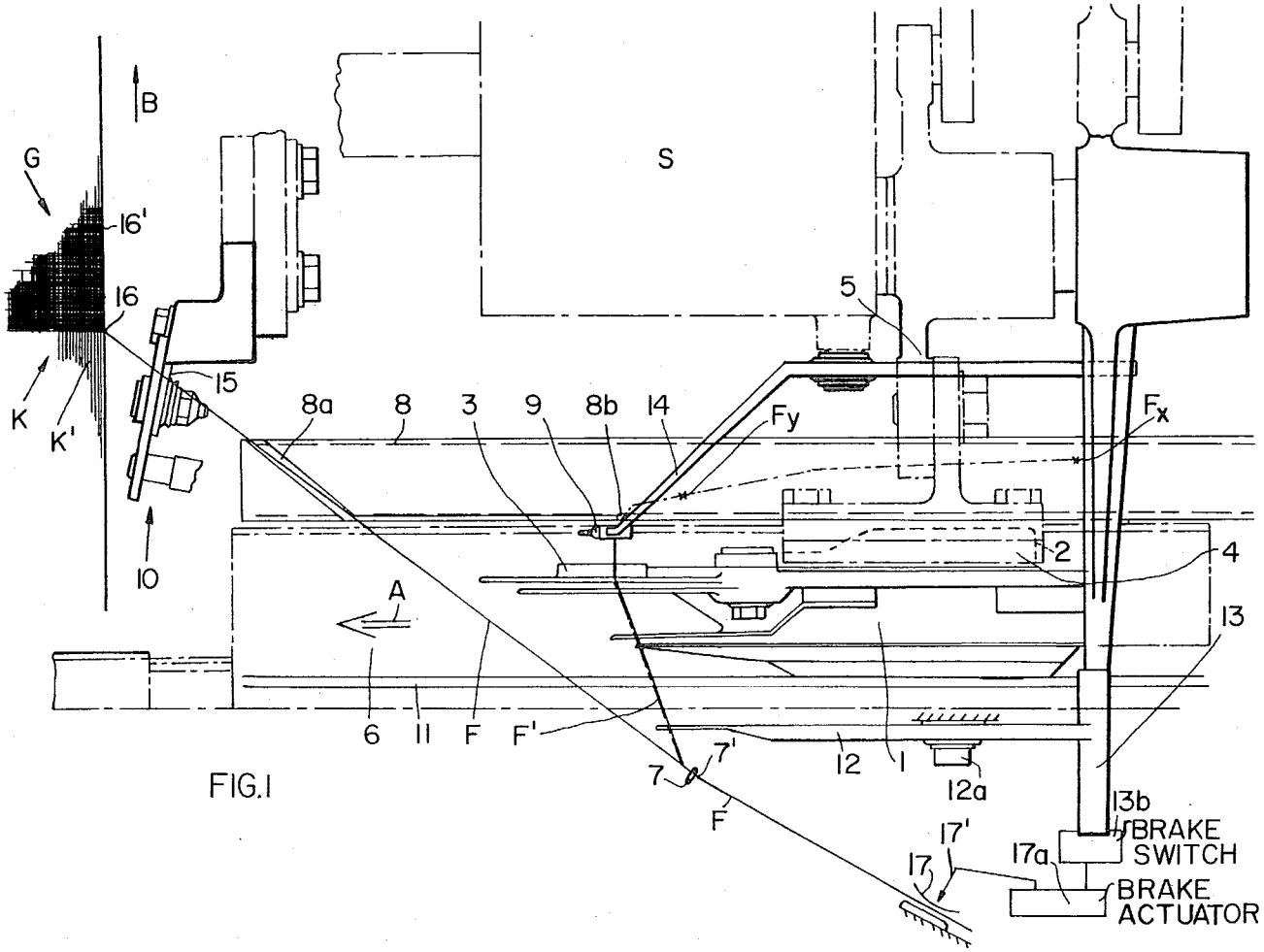
FIG. 1 is a simplified top plan view onto those components of a shuttleless loom which are required for the presentation and seizing of the weft threads.
Figure 2:
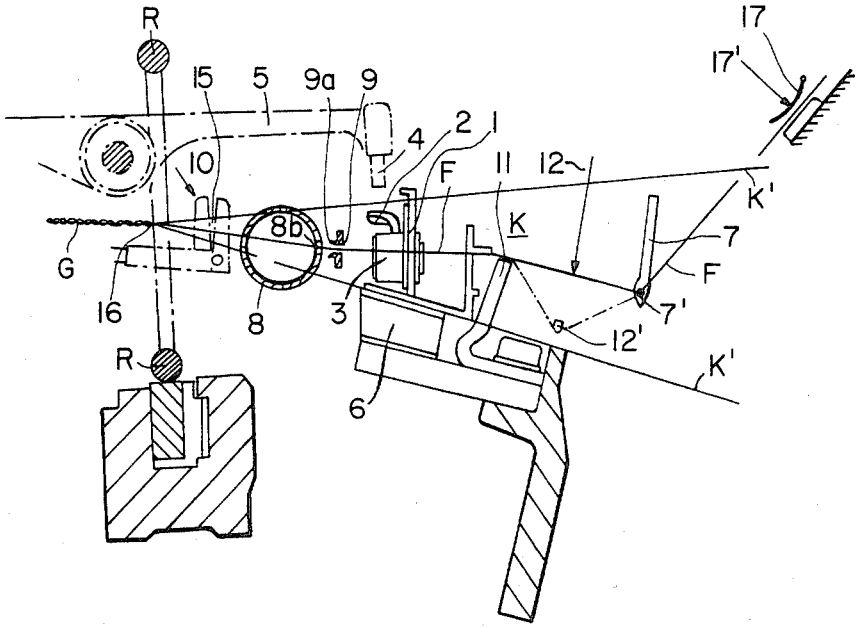
FIG. 2 is a view, partially in section, in the direction opposite to the arrow A in FIG. 1.

The basic construction and operation of the apparatus and method according to the invention will first be described with reference to FIGS. 1 and 2. FIG. 1 shows a top plan view of the weft thread insertion side of the loom. The weft thread F is inserted into the loom shed K and the fabric G moves in the direction of the arrow B. FIG. 2 shows a view partially in section, in a direction opposite the arrow A in FIG. 1. The loom shed K is formed by the warp threads K'. A reed R is shown in its beat-up position as seen in FIG. 2. The binding point 16 at the edge of the fabric G is seen in FIG. 1.

The weft thread F runs outside of the loom shed K from the binding point 16 through a weft thread cutter 10 to the suction opening 8*a* of a pneumatic weft thread holder 8 which is constructed as a suction pipe according to the invention. The weft thread further extends through the eyelet 7' of a movable thread guide needle 7 for presenting the weft thread F to the clamping device 2 of the weft thread inserting gripper 1. Normally, a plurality of such weft thread guide needles 7 are used conventionally. However, here only one such needle 7 is shown for simplicity. The weft thread then continues through a thread brake 17 to the respective weft thread supply reel or spool not shown. The brake 17 is of conventional construction and exerts a brake force 17' the weft thread F. It will be noted that the suction opening 8*a* is a longitudinal slot extending in the thread direction. As a result, the thread F is securely gripped after it has been severed at 15 by the cutter 10. The secure gripping of the cut thread end is possible because the suction effect is applied to a length of thread corresponding to the length of the suction opening slot 8*a*. The suction direction in FIG. 1 is from left to right into the tubular holder 8.

The tubular holder 8 constructed ,as a suction pipe with its suction opening slot 8*a* has a longitudinal axis to which the slot 8*a* extends at a slant as shown in FIG. 1. The longitudinal axis of the suction pipe 8 extends in parallel to the path of the weft thread inserting gripper 1 having a conventional clamping device with a clamping lever 2, or rather a clamping lever 2 for operating clamping jaws 3 located at the forward tip of the gripper 1. The clamping lever 2 opens and closes the clamping jaws 3 in response to a rocker lever 5 carrying a control rail 4. The control rail 4 operates the clamping lever 2 in response to the operation of an excentric control cam not shown, but of conventional construction for pushing the control rail 4 downwardly in a predetermined, time sequence.

When the gripper 1 is in its position outside of the loom shed K, the gripper 1 rests on a support 6 which provides an abutment for the force exerted by the control rail 4. The gripper 1 is further guided by a lateral guide rail 11 along which the gripper 1 slides during its back and forth movement. The insertion direction of the gripper 1 is shown by the arrow A on the slide support 6 for the gripper 1.

Figure 3:
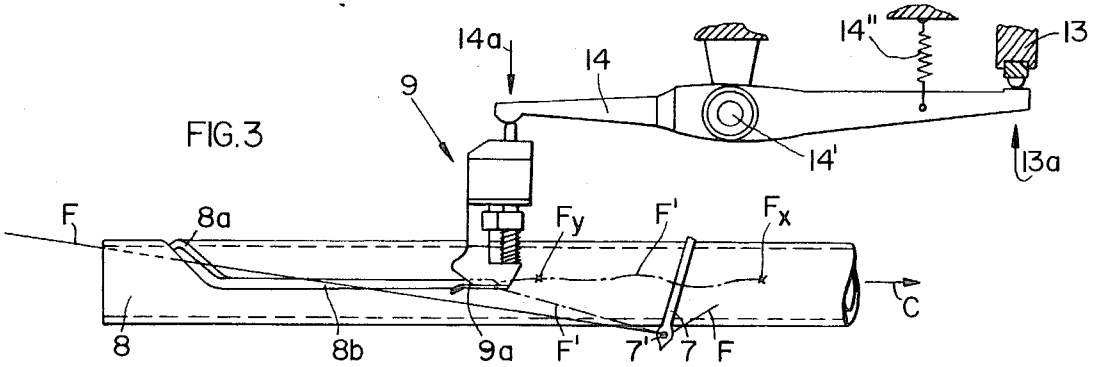
FIG. 3 is a side view of the thread end holder acoording to the invention, constructed as a suction pipe.

Prior to the insertion of a new weft, the weft thread F is severed at 15 by the cutter 10. The cutter 10 is so located that the cutting point 15 is close to the edge 16' of the fabric G. The end of the thread connected with the fabric G projects slightly outside the fabric edge 16'. This thread end may be further processed as is conventional and such further processing is not relevant to the invention. The other cut end F' of the weft thread still passses through the eyelet 7' of the thread presenting needle 7 and is still connected to its supply reel not shown. This other thread end F' is sucked into the suction slot 8*a* of the suction pipe 8. Due to the slant of the suction slot 8*a* in the direction of the weft thread, it is assured that the cut end F' is securely held in the suction pipe. Since the suction pipe 8 also comprises a longitudinal channel 8*b* as best seen in FIG. 3, and since this channel 8*b* merges into the suction slot 8*a*, the thread end is sucked into the suction pipe until it assumes the dash-dotted position shown, for example, in FIG. 1 at F'. The free end Fx of the weft thread assumes the position shown in FIG. 3 under the influence of the suction in the pipe 8. The right-hand end of the channel 8*b* is located approximately in the range of the clamping jaws 3 of the gripper 1 when the latter is in its most withdrawn position, namely, when it is at a standstill. The clamping jaws 3 are opened when the gripper 1 is in this end position. Thus, the end portion F' of the weft thread can assume the position shown in FIG. 1 between the eyelet 7' and the free end point Fx. As a result, the end F' is automatically threaded into the space between the gripper jaws 3.

At this time, a finger 12 is operated by the control mechanism S through an actuating lever 13 which tilts the finger 12 about its journal point 12*a* into a working position 12' best seen in FIG. 2, whereby the weft thread end F' is pulled back to some extent out of the suction pipe 8. However, the suction in the suction pipe 8 keeps holding the free end of the weft thread. This pull-back operation as such is conventional and described in more detail in the above mentioned German Patent (DE-PS) No. 3,243,628. The continuing effect of the suction in the pipe 8 makes sure that the end of the weft thread remains straightened out while the free end Fx moves into a position Fy. In this position only a very short end portion of the weft thread projects from the jaws 3 of the clamping device forming part of the gripper 1, whereby waste of weft thread is substantially reduced.

The above mentioned thread brake 17 is provided to make sure that the thread pull-back arm 12 cannot pull excess thread off the supply reel to form an undesirable slack. The braking force or action of the thread brake 17 is conventionally-controllable as indicated by the arrow 17' in FIG. 1. Depending on the kind of thread and the thread diameter, the braking force can be increased or decreased as is conventional. The thread brake 17 is, for example, controllable by a brake actuator 17*a* activated by a brake switch 13*b* operated by the lever 13.

In any event, the thread brake 17 makes sure that the pull-back force exerted by the arm 12 is effective only on the free end F' of the weft thread F.

The control mechanism S is a conventional excentric cam control which operates a rocking lever 5 which in turn actuates the control rail 4 of the clamping lever 2 of the gripper clamping device. As soon as the rail 4 releases the lever 2 the clamping jaws 3 are closed by springs not shown when the gripper 1 is at a standstill. Thus, the control rail 4 does not need to be equipped with a special control or cam curve, rather, it can be embodied by a short control finger, if desired. Such a structure is substantially lighter than conventional control rails.

The just described clamping of the free end F' by the jaws 3 while the gripper 1 is at standstill makes it possible to move the gripper 1 in the direction of the arrow A only after the thread end has been securely seized by the clamping jaws 3. Thus, only small spring forces are needed for closing the clamping jaws 3, whereby the thread is handled gently. Further, due to these small spring forces the gripper 1 is only lightly pressed against the sliding surface of the support 6, whereby again the thread in the clamping jaws 3 is gently handled, and the friction between the gripper 1 and the surface of the support 6 is reduced.

It has been found that the present method provides a substantial improvement even if the entire thread transfer of the weft thread end into the clamping device 3 of the gripper 1 does not take place completely while the gripper 1 is at a standstill. In this modification the timed sequence of the thread transfer into the gripper jaws is such that the thread end F' enters into the opened jaws while the gripper is at a standstill, but the closing of the gripper jaws takes place at the latest when the gripper starts moving. Thus, the gripper jaws 3 may be closed when the clamping lever 2 leaves the reach of the control rail 4. This type of operation can easily be accomplished by adapting the program in the control mechanism S or by replacing the control rail 4 by a respectively shaped and positioned stationary control rail.

A mechanical auxiliary thread clamp 9 may be located at the end of the suction channel 8*b* as shown in FIG. 1. Such an auxiliary clamp 9 does not need to be a controlled clamp and may, for example, comprise elastic clamping elements 9*a* which converge in the direction toward the end of the suction channel 8*b*, please see FIG. 3. Thus, the free end F' of the weft thread is pulled automatically by the suction in the suction pipe 8 into the auxiliary clamp 9, whereby the clamp 9 augments the holding effect of the suction pipe 8 when the thread is pulled back by the pull-back member 12. When the gripper 1 moves into the shed, the now closed clamping jaws 3 pull the thread end again out of the auxiliary clamp 9. It is advantageous to make the clamping elements 9*a* of the auxiliary clamp 9 so that they also converge in the cross-direction, that is, toward the gripper 1. Thus, the clamping elements 9*a* would converge in the direction of the thread pull-back by the pull-back member or finger 12. The clamping force of the auxiliary clamp 9 is selected so that an additional brake force is effective on the weft thread end F′ during pull-back. This feature has the advantage to assure a proper holding of the weft thread end F′ even if the latter should be rather short.

Rather than using a noncontrolled auxiliary clamp 9, it is possible to use a controlled auxiliary clamp which may be coupled, for example with the thread pull-back member 12 in such a way that the controlled auxiliary clamp is closed at least during the time when the thread pull-back member 12 is tilted from its rest position into its working position 12′, please see FIG. 2.

The auxiliary clamp 9 may be controlled by a two arm operating lever 14 as shown in FIG. 1, whereby the two arm lever 14 may be tilted by the control lever 13. Thus, the control lever 13 serves simultaneously for the control of the thread pull-back member or finger 12 and of the two armed lever 14 for controlling the auxiliary clamp 9. However, in order not to clutter up the illustration, the details of the tilting of the two armed lever 14 are not shown since they are conventional. The timing of the auxiliary clamp control may be adjusted or adjustable so that, for example, the auxiliary clamp 9 may already be closing while the weft thread end F′ is sucked into the suction pipe 8 forming the holding device.

The thread end holding device 8 in the form of a suction pipe is shown in more detail in FIG. 3, whereby the suction is effective in the direction of the arrow C. The full line weft thread F comes from a supply reel not shown and passes through the eyelet 7′ of the thread presenting member or needle 7. The direction of the suction slot 8*a* is such, that the thread F is guided by the slot 8*a* between the binding point 16 and the eyelet 7′ as is also seen in FIG. 1. The longitudinal suction channel 8*b* in the suction pipe 8 extends from the suction slot 8*a* to a point next to the auxiliary clamping element 9*a*. Once the thread is cut the cut end F′ of the thread is bent over at the right-hand end of the channel 8*b* by the suction effect, whereby the end F′ takes up the dash-dotted position shown in FIG. 3. The free end Fx may reach into the pipe as shown due to the suction effect and the free end is moved back to the location Fy under the action of the pull-back finger 12 as described above.

If the auxiliary clamp 9 with its clamping elements 9*a* is a controlled auxiliary clamp, the above mentioned lever 14 may be constructed as a rocking lever tiltable about a journal pin 14′ and pulled against the control lever 13 by a spring 14″ tending to hold the left-hand end of the control lever 14 in contact with the auxiliary clamp 9 as symbolically indicated by the arrow 14*a*. Depending on the movement of the control lever 13 indicated by the arrow 13*a*, the clamping force of the auxiliary clamp 9 may be controlled. The suction force and the clamping force of the clamp 9 together make sure that even a very short end of the cut-off weft thread will not escape from the suction guide channel 8*b* until the jaws 3 have properly seized the thread for the next insertion.

Figure 4:
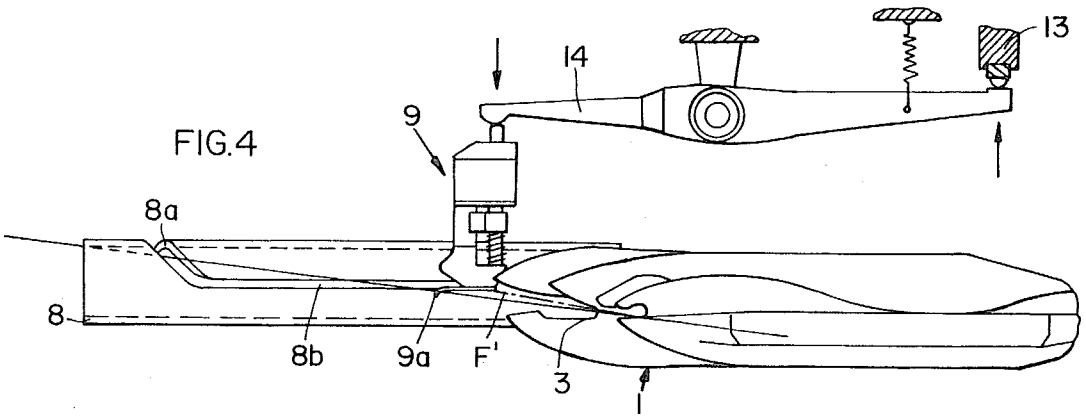
FIG. 4 is a side view similar to that of FIG. 3, however also illustrating the gripper clamping device.

FIG. 4 is a view similar to that of FIG. 3, but showing a side view of the suction pipe 8 in combination with a mechanical auxiliary clamp 9 controlled as described with reference to FIG. 3. However, FIG. 4 additionally shows the gripper 1 with its jaws 3 in the rearmost position, that is, in the stationary position. The thread presenting needle 7 is not shown in FIG. 4. The illustration in FIG. 4 is such that the gripper 1 is shown slightly to the right of its normal rest position in order to make the auxiliary clamp 9 properly visible. In practice it is advantageous that the clamping jaw 3 is located at the end of the suction channel 8*b* next to the auxiliary clamp 9. FIG. 4 shows that the thread end sucked into the suction guide channel 8*b* is pulled along the length of the channel 8*b* backwardly toward the gripper and that additionally the channel 8*b* guides the thread end directly into the opened clamping jaws 3 of the gripper 1. The channel 8*b* also guides the thread into the clamping elements 9*a* of the auxiliary clamp 9. Thus, the channel 8*b* performs a suction function and a guide function. FIG. 4 does not show the control means for operating the clamping jaws 3 since they have been described above with reference to FIGS. 1 and 2. Besides, the control of the operation of the gripper jaws 3 of the gripper 1 is known as such.

FIG. 5 is again a view similar to that of FIG. 3, but now showing the operation of the thread pull-back member 12 and its cooperation with the thread presenting needle 7. The thread pull-back member or finger 12 is journalled on a journal axis 12*a* for movement between the full line rest position 12 and the dash-dotted working position 12′. A control lever 13*a* operates the pull-back member 12. The weft thread F coming from the supply reel is bent over at its end F′ as shown by the dash-dotted line so that this free end F′ reaches around the end of the suction channel 8*b* into the suction pipe 8 to the point Fx representing the cut end. The pull-back member 12 moves into the dash-dotted position 12′ for pulling the thread back as described above, whereby the end of the thread moves from the point Fx to the point Fy so that the thread portion protruding from the gripper jaws 3 is optimally shortened and weft thread waste is further reduced.

Figure 5:
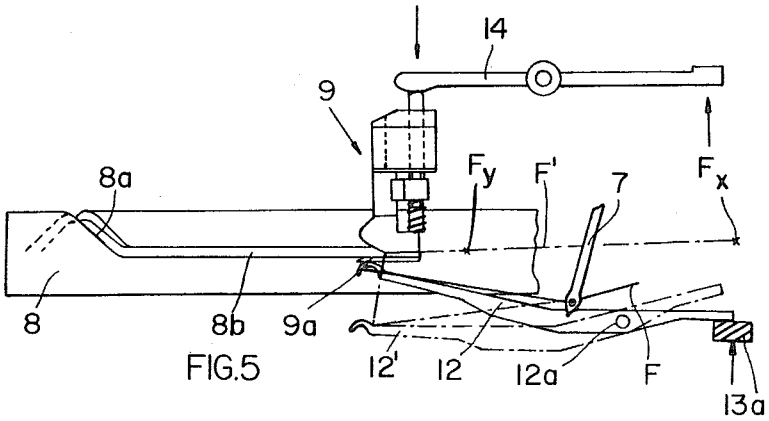
FIG. 5 is a view similar to that of FIG. 3, but further illustrating the thread pull-back member.
Figure 6:
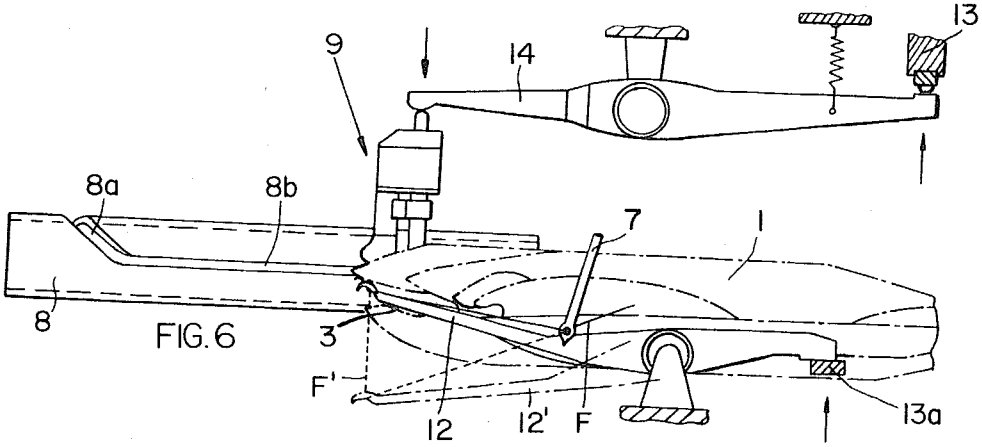
FIG. 6 is a view similar to that of FIG. 3, but illustrating the cooperation of the gripper clamping device, the thread pull-back member, and the thread presenting device.

FIG. 6 shows all components of the FIGS. 3, 4, and 5 in a single combined view. The gripper 1 is shown in dash-dotted line to distinguish it more easily from the other components. The thread end F′ between the eyelet 7′ of the thread presenting needle 7 and the entrance to the gripper jaws 3 is shown in dashed lines pulled back by the pull-back member in its working position 12′. Thus, the free end F′ of the thread F is introduced into the clamping jaws 3 of the gripper 1 and into the auxiliary clamp 9. Pulling the thread F′ down by the pull-back member 12 does not change the position of the thread portion in the open clamping jaws 3. Thus, the clamping jaws 3 can be closed as described above and the so seized weft thread can be inserted into the loom shed K. The seizing and clamping of the weft thread by the clamping jaw 3 takes place in a very gentle manner so that the above mentioned disadvantages of prior art devices with regard to rough handling of the weft thread are avoided. The timing for closing the clamping jaws can be adjusted to an optimal value by a respective adjustment of the control device S operating jaw closing fingers or levers. In the alternative, the clamping jaws can be opened and closed by a fixed control rail having such a control cam that the clamping jaws 3 are closed directly at the beginning of the feed advance motion of the gripper into the loom shed. Even in that case the advantages of the invention are substantially achieved, although the weft thread F is not seized at the exact standstill of the gripper, but rather, at the beginning of the gripper motion. These advantages are achieved even if an auxiliary clamp 9 is not used. However, with the aid of the auxiliary clamp 9 the waste of weft thread material can be further reduced.

Although the invention has been described with reference to specific example embodiments, it will be appreciated, that it is intended to cover all modifications and equivalents within the scope of the appended claims.

What I claim is:

1. A method for inserting a weft thread into a loom shed of a shuttleless loom, wherein two gripper rods are movable into and out of a loom shed from opposite sides of the loom shed for inserting said weft thread into said loom shed with the aid of controllable gripper clamps carried by said gripper rods, comprising the following steps:

(a) cutting an already inserted selected and presented weft thread to form a connected weft thread end that is still connected to its weft thread supply reel;

(b) seizing said connected weft thread end of a cut weft thread by a thread end holder (8) exerting a yielding holding force on said connected thread end;

(c) inserting said seized connected thread end into one of said gripper clamps when said gripper rod with said one gripper clamp is at a standstill or still at a low speed completely outside said loom shed for transporting a new weft thread into said loom shed;

(d) continuing to hold the weft thread end by said thread end holder with a yielding effect;

(e) maintaining the yielding effect while pulling back a portion of the weft thread out of said thread end holder to shorten the free weft thread end; and (f) closing said one gripper clamp at the latest when said gripper rod carrying said one gripper clamp starts moving in a thread inserting direction, for pulling the already clamped weft thread end out of said thread end holder when the gripper clamping means move toward the loom shed.

2. The method of claim 1, further comprising applying a braking force to the weft thread at least at a time during an end part of said pulling back and during said seizing of said thread end by said gripper clamping device, said braking force being applied to said weft thread at a point between a gripper path of said rod and said weft thread supply reel.

3. The method of claim 1, wherein said yielding holding force is applied to said weft thread end by suction through said thread end holder.

4. An apparatus for inserting a weft thread into a loom shed, comprising gripper rod means (1) movable into and out of the loom shed (K), clamping means (3) carried by said gripper rod means for seizing a weft thread (F), movable thread guide means (7) for guiding a weft thread, severing means (10) for cutting an inserted weft thread, thread end holder means (8) arranged between said severing means (10) and said clamping means (3) for presenting a thread end to said clamping means, and thread pull-back means (12) for drawing a length of thread partially back out of said thread end holder means (8) to reduce weft thread waste, said thread end holder means comprising a suction pipe (8) having a suction opening **(8*a*) close to a cutting point of said severing means and a suction channel (8*b*) extending lengthwise in said suction pipe from said suction opening to a channel end in an area laterally next to said clamping means (3)** in a clamping means rest position for yieldingly holding and guiding a weft thread end into said clamping means.

5. The apparatus of claim 4, wherein said suction opening **(8*a*) is a suction slot extending substantially in a direction corresponding to a line connecting said cutting point (15) and a point (7') defined by said thread guide means (7)**.

6. The apparatus of claim 4, wherein said thread pull-back means (12) are arranged between a path of said gripper rod means (1) and said thread guide means (7).

7. The apparatus of claim 4, further comprising auxiliary mechanical clamping means (9) located next to said channel end in said area laterally next to said clamping means, for augmenting a holding force exerted by said suction pipe.

8. The apparatus of claim 7, wherein said auxiliary clamping means comprise control means (14) for actuating said auxiliary mechanical clamping means.

9. The apparatus of claim 7, wherein said auxiliary clamping means comprises elastic clamping elements.

10. The apparatus of claim 9, wherein said elastic clamping elements converge relative to said suction channel **(8*b*)**.

11. The apparatus of claim 9, wherein said elastic clamping elements converge in a direction extending in the thread pull-back direction.

12. The apparatus of claim 7, further comprising control means arranged for controlling said auxiliary mechanical clamping means and said thread pull-back means in unison.

13. The apparatus of claim 7, wherein said auxiliary mechanical clamping means are not controlled.

* * * * *